United States Patent [19]

Richmond et al.

[11] Patent Number: 4,777,691

[45] Date of Patent: Oct. 18, 1988

[54] MOTOR DRIVEN BRUSH ASSEMBLY FOR VACUUM CLEANER

[75] Inventors: Clark S. Richmond; David A. Erickson, both of Bloomington, Ill.

[73] Assignee: National Union Electric Corporation, Ill.

[21] Appl. No.: 920,775

[22] Filed: Oct. 20, 1986

[51] Int. Cl.[4] ..... A46B 7/10

[52] U.S. Cl. ..... 15/182; 15/366; 15/386; 15/183; 300/21

[58] Field of Search ..... 15/176, 179, 182, 183, 15/184, 366, 383; 285/31, 32; 300/7, 30, 21

[56] References Cited

U.S. PATENT DOCUMENTS

| | | | |
|---|---|---|---|
| 1,999,696 | 4/1935 | Kitto | 15/179 |
| 2,707,792 | 5/1955 | Waller | 15/182 |
| 2,734,211 | 2/1956 | Vance | 15/182 |
| 3,683,444 | 8/1972 | Schaefer et al. | 15/183 |
| 4,209,873 | 7/1980 | Schaefer | 15/182 |
| 4,312,542 | 1/1982 | Schaefer | 300/21 |

*Primary Examiner*—Philip R. Coe
*Assistant Examiner*—Stephen F. Gerrity
*Attorney, Agent, or Firm*—Alfred E. Miller

[57] ABSTRACT

A cylindrical motor driven brush for a vacuum cleaner or the like having a hollow outer cylinder and a plastic bristle tube assembly for insertion in the outer cylindrical tube. The insert tube is provided with a helical mounting strip with brush bristles thereon which is inserted through a correspondingly shaped slot in said outer cylindrical tube.

6 Claims, 5 Drawing Sheets

6
6
10
14
12
16

10

5
5
24
22
18
26
26
24
23

18
24
22
24

FIG.18
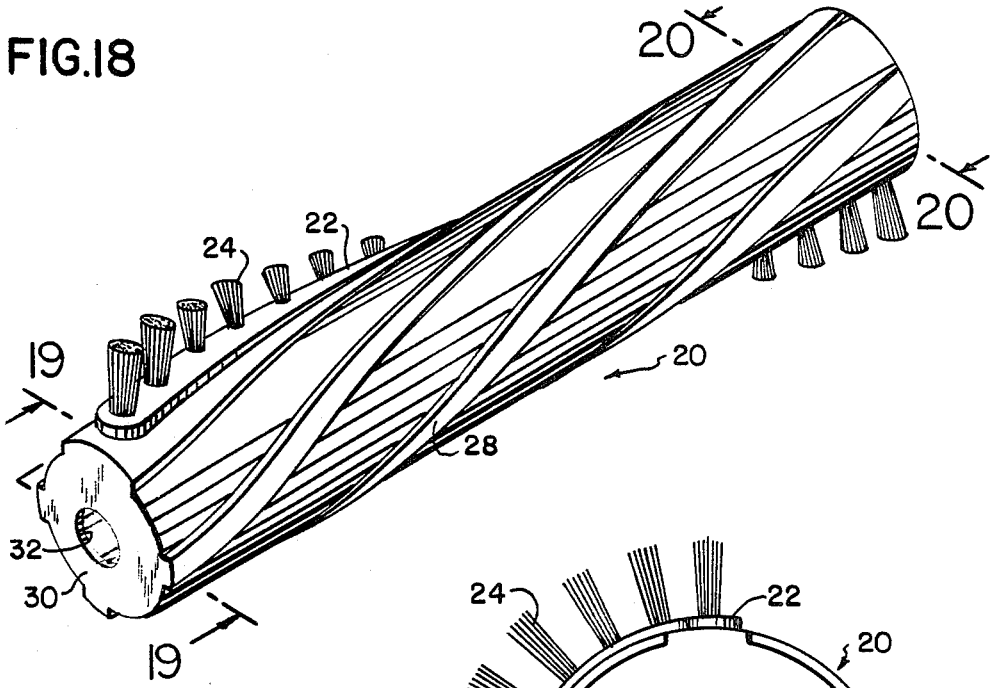
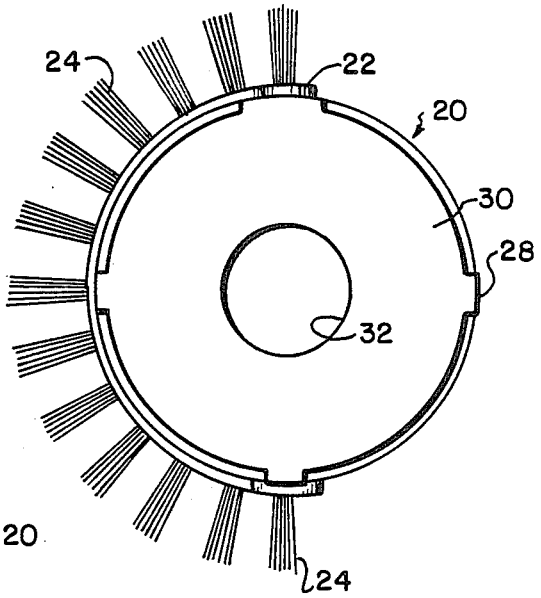
FIG.19
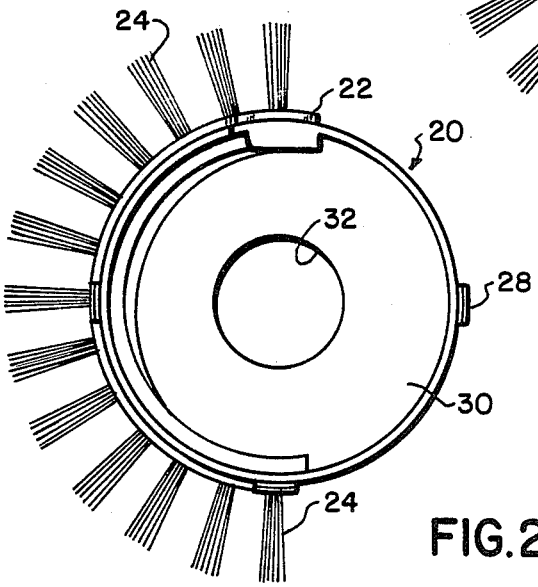
FIG.20

MOTOR DRIVEN BRUSH ASSEMBLY FOR VACUUM CLEANER

The present invention relates to a motor driven brush assembly of the type generally used in upright vacuum cleaners as well as power head, cannister-type suction cleaners. A suction cleaner brush roll assembly is known and is of the type shown in U.S. Pat. Nos. 3,683,444 to Harold W. Schaefer et al and 4,209,873 to Harold W. Schaefer. The brush roll shown therein is mounted within the cleaner body and is rotated by a belt drive passing around a groove located somewhat centrally on the brush roll. The brush members are inserted through longitudinally disposed helical slots. As seen in the patent to Schaefer et al, it is necessary to utilize a separate helically shaped beater element which is slid into correspondingly shaped slots in the beater-brush bar assembly. It should be apparent that the manufacture and assembly of a suction cleaner brush roll assembly as set forth in the patent to Schaefer et al is costly and relatively complex to manufacture and assemble.

It is the principal object of the present invention to provide a motor driven brush roll assembly for a vacuum cleaner, which may be either an upright or a tank-type, in which the brush roll cylinder is hollow and is provided with helical slots, whereby a cylindrical tube assembly with a bristle brush is inserted within said hollow tube with the brush mounting element thereon being slid into helical slots, thereby providing a novel combination of a brush roll tubular body member together with an internal tubular bristle assembly which can be easily inserted and removed therefrom, thereby reducing the known complex function of assembling a beater-brush roll in power-driven suction cleaners.

A further feature of the present invention is to provide a tubular brush roll insert having the bristles of the brush stapled to the roll, and which is inserted within an outer steel cylindrical tube, and is provided with a means for removably attaching said insert therein for rotational movement with the outer tube. The assembly further includes a bearing, a brush roll cap and a hexagon mounting ring.

Another object of the present invention is to provide a plastic bristle tube assembly for insertion within an outer cylindrical tube, said plastic tube having a series of helical longitudinally disposed ribs to function as an aid in the removal of the bristle tube assembly from its injection moulding machine.

In order that the present invention will be more clearly understood, it will now be disclosed in greater detail with reference to the accompanying drawings, in which:

FIG. 18 is a perspective view of a plastic cylindrical insert showing the bristles on a mounting strip.

FIG. 19 is a view taken along the line 19—19 of FIG. 18; and

FIG. 20 is a view taken along the line 20—20 of FIG. 18.

Figure 1:
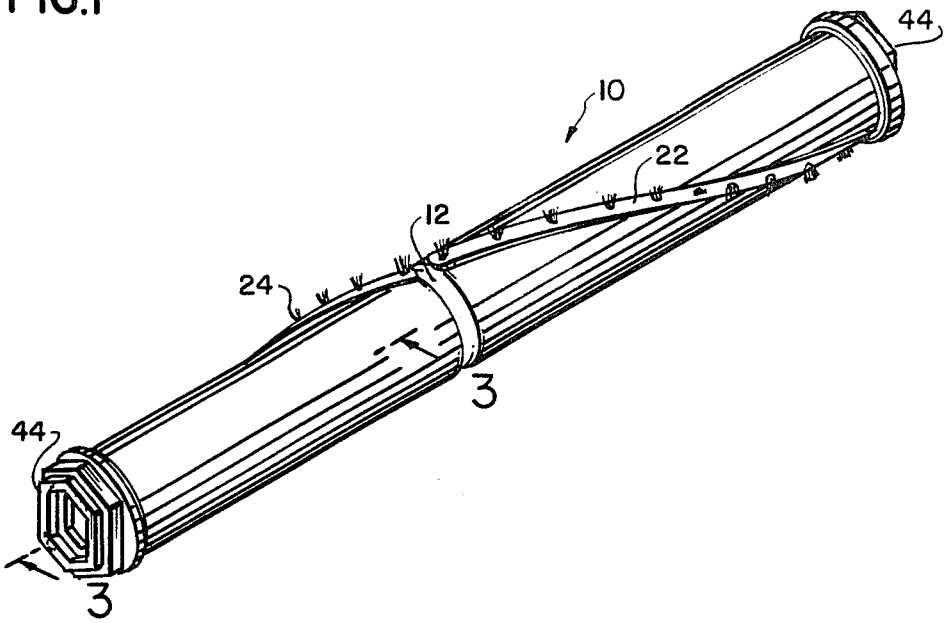
FIG. 1 is a perspective view of the motor driven brush roll assembly for a vacuum cleaner constructed in accordance with the teachings of my present invention.
Figure 2:
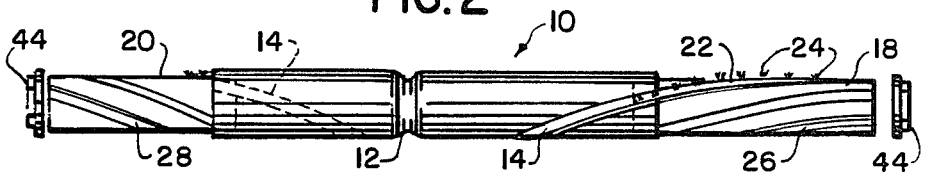
FIG. 2 is a front elevational view of the motor driven brush assembly for a vacuum cleaner, reduced in size and showing the bristle tube assembly inserts partially inserted within the hollow steel outer tube.
Figures 4, 5, 6, 7:
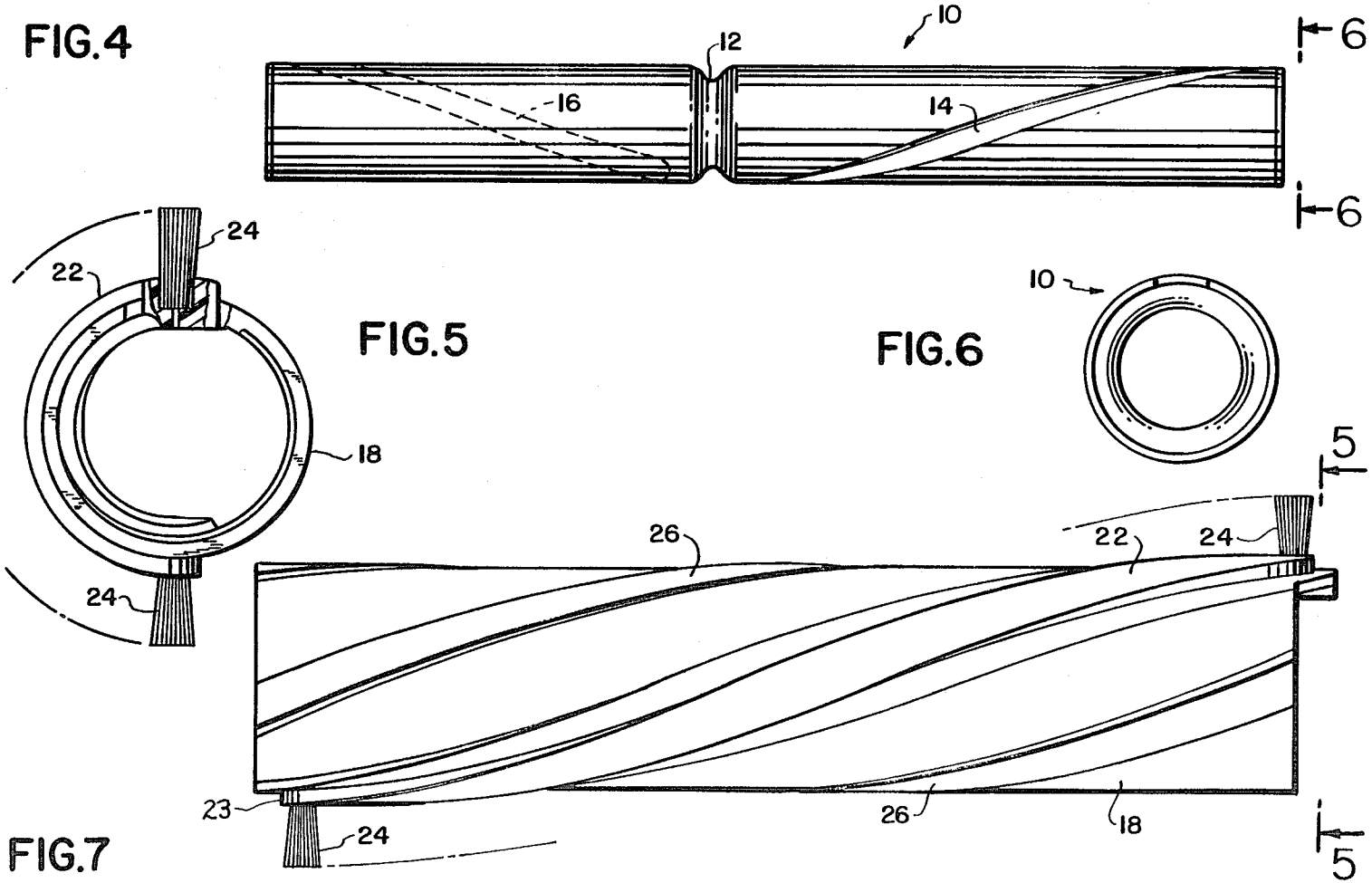
FIG. 4 is a front elevational view of the steel outer tube of the motor driven brush roll showing the helical slots cut therein.
FIG. 5 is a end elevational, but enlarged view taken along the line 5—5 of FIG. 7.
FIG. 6 is a end elevational view taken along the line 6—6 of FIG. 4.
FIG. 7 is an enlarged front elevational view showing the plastic tube assembly for insertion within the steel tube having bristles fixed to the plastic tube in a helical arrangement corresponding to the helical slots in the steel tube.
Figure 8:
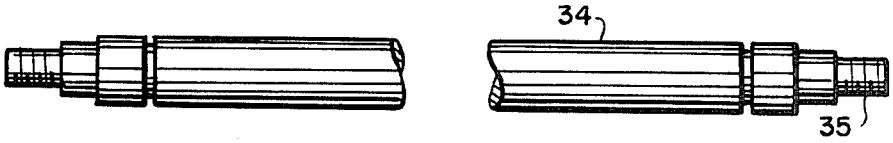
FIG. 8 is a front elevational view of the central shaft on which said motor driven brush assembly is mounted for rotational movement.
Figure 9:
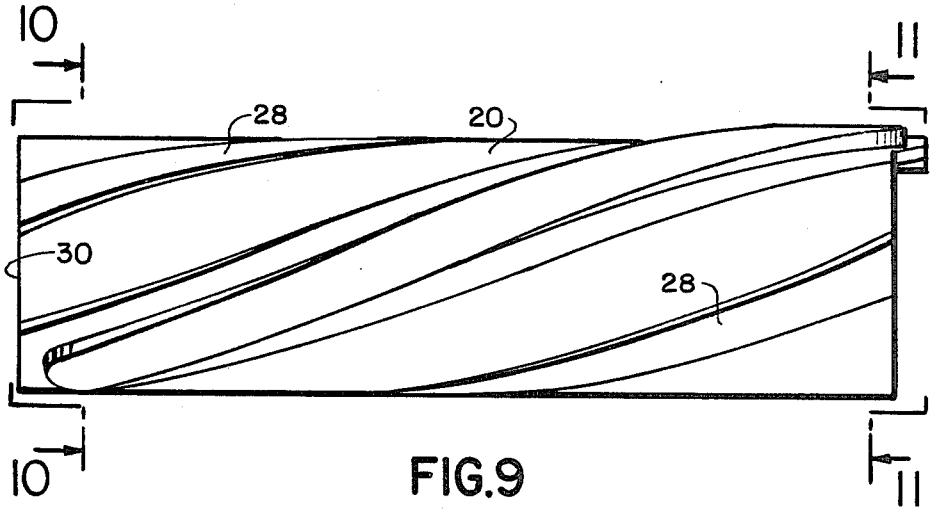
FIG. 9 is an enlarged view of one of the plastic bristle tube assemblies showing the raised helical ribs extending substantially longitudinally along the body of the tube.
Figure 10:
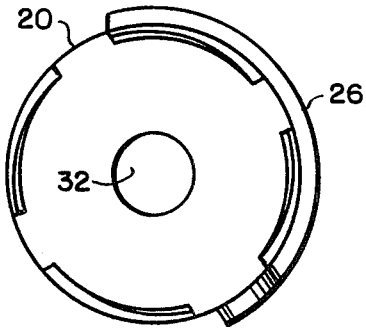
FIG. 10 is an end elevational view taken along the line 10—10 of FIG. 9.
Figure 11:
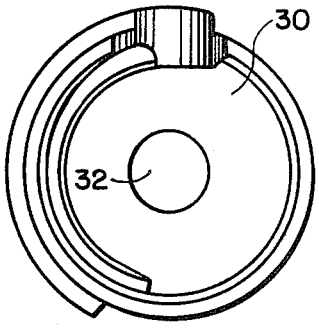
FIG. 11 is an opposite end elevational view taken along the line 11—11 of FIG. 9.
Figure 12:
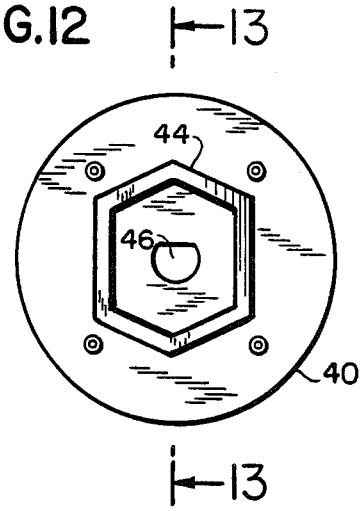
FIG. 12 is an end elevational view of the steel outer tube showing the end cap provided with an hexagonal mounting ring and a central hole for the central shaft.
Figure 13:
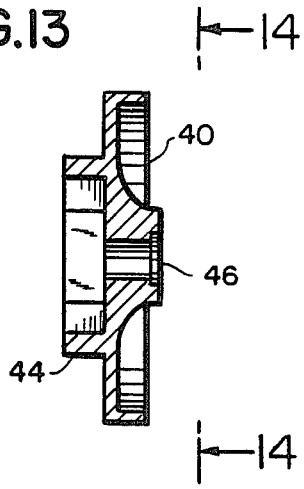
FIG. 13 is a sectional view taken along the line 13—13 of FIG. 12.
Figure 14:
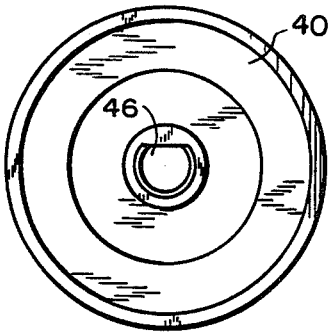
FIG. 14 is an end elevational veiw of the opposite side of the steel tube cap.
Figure 15:
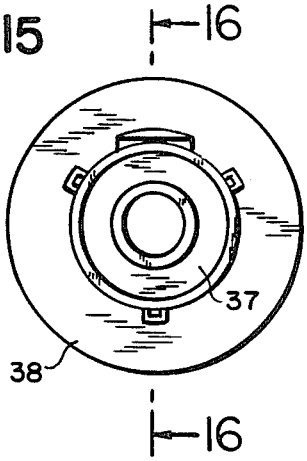
FIG. 15 is an end elevational view of the bearing retainer element for the outer steel tube.
Figure 16:
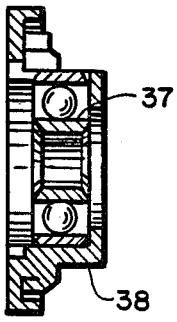
FIG. 16 is a view taken along the line 16—16 of FIG. 15.
Figure 17:
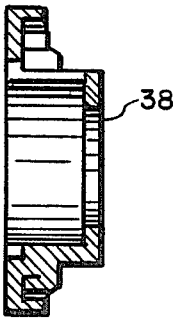
FIG. 17 is a side elevational view of the bearing retainer without the bearing assembly.

Referring to the drawings, an outer cylindrical brush roll 10, which is adapted to be motor driven, is referred to generally by the reference numeral 10 and may be fabricated of steel or any other suitable material. The roll 10 is hollow and is provided with an annular recess 12 which is somewhat centrally located but positioned closer to one end of said cylindrical roll than the other end. It is to be noted that in some configurations of the cylindrical brush roll the annular recess can be located precisely centrally (not shown) which depends upon the particular drive arrangement that is used. The annular recess 12 is adapted to engage a drive belt (not shown) which is adapted to rotate within the vacuum cleaner housing (not shown) in order to enable the rotation of the cylinder 10. It should be apparent that although the driving technique described above is preferred for the present assembly, other driving arrangements may be utilized with the invention, it being evident that the provision of a driving pulley mounted at the end of the cylinder 10 may be alternately employed. This latter arrangment for driving a brush assembly is, of course, well known. As seen in FIGS. 2 and 4, the outer cylindrical tube 10 is provided with generally spiral slots 14 and 16 extending generally helically along the circumference of the brush roll cylinder 10 from opposite open ends of the cylinder. It should be noted that the right hand cylindrical section of the tube roll 10 is longer than the left hand section thereof, however, if the cylindrical brush roll configuration has a central annular recess, the right and left hand cylindrical sections would be identical in length.

Each open end of the cylindrical outer tube 10 is constructed to receive cylindrical inserts 18 and 20 which are adapted to be slid in and to fit snuggly within the outer tube 10. In this connection, it should be evident that the outer tube 10 is preferably fabricated of steel, but may be manufactured of any other suitable material which will withstand heavy wear. On the other hand, the insert tubes 18 and 20 are preferably fabricated of a plastic, such as polypropylene, and each is provided with a raised mounting strip 22 to which the bristles 24 are stapled. The mounting strip 22 is correspondingly shaped to the helical slots 14 and 16 so that tubular inserts 18 and 20 can be inserted in opposite open ends of the outer steel brush roll 10 with the respective mounting strip 22 entering the open ended slots 14 and 16 and tracking within the slots until the inserts have been fully inserted within the respective tubular sections of the outer steel tube 10. It should be apparent that since the recess 12 is located somewhat centrally on the outer steel tube 10, this construction forms an abutment stop for the inner ends of the inserts 18 and 20 when they are fully inserted within the outer steel tube 10 while the inner ends 23 of the raised mounting strips 22 abuts against the inner ends of helical slots 14 and 16. Moreover, it should be noted that the plastic tubular inserts 18 and 20 are provided with further helically disposed ribs 26 and 28, respectively. These ribs project a distance from the outer surface of the plastic inserts 18 and 20 which is less than the distance the mounting strip 22 projects from the outer surface of each of the plastic inserts. The ribs function as an aid in the removal of the plastic cylindrical roll from an injection molding machine. Moreover, it should be noted in FIG. 5 that the radially extending brushes 24 are stapled to the plastic base material of the holders 22.

The cylindrical inserts 18 and 20 are also hollow but are provided at the ends adjacent to the annular recess 12 with an end wall 30 which closes the respective end thereof with the exception of a central opening 32 therein. Thus, passing through a hollow center of both said outer steel tube 10 and the openings 32 in the plastic cylindrical inserts 18 and 20 is a central shaft 34 upon which said outer steel tubular brush assembly is rotated by means of a motor driven belt located in annular recess 12. Shaft 34 has ends 35 which are out-of-round and contain a flat surface that corresponds with the out-of-round opening 46 in the end cap member 40.

Figure 3:
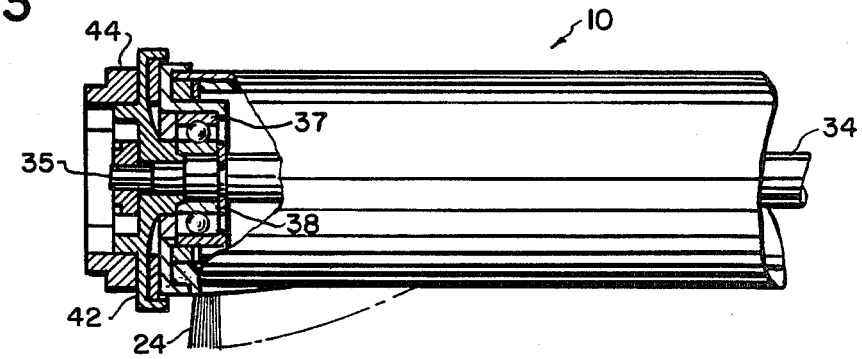
FIG. 3 is a partial sectional, but enlarged view taken along the line 3—3 of FIG. 1.

The preferred rotary mounting of the brush assembly of the invention is shown in FIG. 3 in which a bearing assembly 37 is maintained on opposite ends of the brush roll assembly and is held in place by means of a bearing retainer 38 and is further provided with a cap member 40 which is adjacent to the bearing retainer. At the extreme outer end of the central shaft 34 is mounted a hexagon shaped mounting ring 44. In this connection, the opposite parallel sides of the mounting ring are adapted to engage parallel surfaces in the vacuum cleaner housing (not shown) in order to prevent rotation of the end elements when the brush is power driven. Thus, only the cylindrical brush roll is rotated whereas a shaft and the shaft mounting elements remain stationary. Other constructions of the cylindrical brush roll are contemplated within the spirit and scope of the present invention. One of these may take the form of an outer cylindrical metal brush roll having a powdered metal sleeve bearing, however, this construction also is provided with a co-axial cylindrical plastic insert mounting within an outer steel brush roll as hereinbefore described and shown.

It should be evident that the present invention may be provided with a single insert similar to cylindrical inserts 18 and 20 if provision is made for rotating the outer steel tube 12 at one end thereof. In that case, the construction of the outer steel tube is such that there is no obstruction to inserting an elongated plastic tubular insert along the entire length thereof in which a mounting strip enters the open end of a helical slot similar to the slots 14 and 16 and extends internally throughout the entire length of the outer tube 12. The plastic insert carries the mounting strip together with brush bristles stapled thereto and can be easily inserted and removed when the brush bristles become worn and are no longer effective to clean the surfaces to be treated. As seen in FIGS. 5 and 7, the mounting strip 22 for the bristles has a sufficient height dimension to be frictionally held within the slots 14 and 16 of the outer steel tube 12 and to thereby cause the brush bristles to efficiently agitate a rug or other floor surface to be treated.

FIGS. 18–20 show the cylindrical insert 20 which is proportional to fit snugly through one of the open ends of the outer correspondingly cylindrical tube 10. The mounting strip 22 with upstanding brush bristles 24 are clearly seen. In addition, the helically disposed ribs 28 are shown on the outer surface of the insert 20. It should also be apparent that inner end of the insert 20 is provided with an end wall 30 and a central opening 32 through which the central shaft 34 passes as described hereinbefore.

While the present invention has been disclosed and described with reference to a single embodiment of the invention, it is apparent that other variations and modifications may be made therein, and it is therefor intended that the following claims cover each variation and modification which falls within the true spirit and scope of the invention.

What is claimed is:

1. A brush roll assembly capable of rotation in a suction cleaner or the like comprising an elongated hollow outer cylinder of substantially circular cross section, at least one elongated through slot in the outer cylinder being open at the outer end of said cylinder and extending toward the center thereof and disposed generally longitudinally therein, at least one hollow cylindrical insert of a diameter less than the diameter of said outer cylinder, said cylindrical insert having a unitary projecting mounting strip on the outer surface thereof provided with brush bristles, and said cylindrical insert with its unitary projecting mounting strip being mounted within said outer cylinder by being inserted through an open end of said outer cylinder while said mounting strip is slid through the open end of said elongated slot to thereby be held therein to form said brush roll assembly, and said cylindrical insert being capable of being removed from said outer cylinder with bristles thereon by pulling said cylindrical insert through said slot and out of an adjacent open end of said outer cylinder.

2. A brush roll assembly as claimed in claim 1 wherein said through slot is helical and said mounting strip is correspondingly shaped.

3. A brush roll assembly capable of rotation in a suction cleaner or the like comprising an elongated hollow, open ended outer cylinder of substantially circular cross section, an annular recess substantially centrally located in said outer cylinder and adapted to receive a driving means for rotating said brush roll, an elongated through slot at each end of the outer cylinder being open at opposite ends of said cylinder and extending toward the center thereof and disposed generally longitudinally therein, a pair of hollow cylindrical inserts of a diameter less than the diameter of said outer cylinder, said inserts each having a unitary projecting mounting strip provided with upstanding bristles therein, said inserts with their unitary mounting strips being mounted in said slots of said outer cylinder from opposite ends thereof whereby said mounting strips and bristles thereon are slid through said correspondingly shaped through slots in said outer cylinder from the open ends thereof to thereby form said brush roll assembly.

4. A brush roll assembly as claimed in claim 3 wherein said brush bristles are affixed to said mounting strip by stapling.

5. A brush roll assembly as claimed in claim 3 further comprising end mounting means on a centrally fixed shaft upon which said brush roll rotates.

6. A brush roll assembly as claimed in claim 3 wherein said hollow cylindrical insert is fabricated of a thermoplastic material, and is provided with a closed end except for a central opening adjacent to the annular recess in said outer cylinder.

* * * * *